US006595431B1

(12) United States Patent
Lieske

(10) Patent No.: US 6,595,431 B1
(45) Date of Patent: Jul. 22, 2003

(54) EXHAUST HEAT TRAP AND REDIRECTING SYSTEM

(76) Inventor: Dennis A. Lieske, 4478 Bent Creek Dr., Cincinatti, OH (US) 45244

( * ) Notice: Subject to any disclaimer, the term of this patent is extended or adjusted under 35 U.S.C. 154(b) by 0 days.

(21) Appl. No.: 10/294,004

(22) Filed: Nov. 14, 2002

(51) Int. Cl.[7] ..... B60H 1/02

(52) U.S. Cl. ..... 237/12.1; 122/19.2; 122/494; 60/39.01

(58) Field of Search ..... 60/39.01, 320; 165/169, 51, 154, DIG. 345, DIG. 346; 122/19.2, 494; 220/567.3, 495.01, 694.1; 237/12.1, 55

(56) References Cited

U.S. PATENT DOCUMENTS

| | | | | | |
|---|---|---|---|---|---|
| 155,917 | A | * | 10/1874 | Beins | 165/73 |
| 1,332,811 | A | * | 3/1920 | Davis | 165/74 |
| 4,448,136 | A | * | 5/1984 | White | 122/18.2 |
| 5,548,957 | A | | 8/1996 | Salemie | |
| 5,603,218 | A | | 2/1997 | Hooper | |
| 5,649,589 | A | * | 7/1997 | Carpentier | 165/70 |
| 5,910,100 | A | | 6/1999 | Hooper | |
| 6,101,813 | A | | 8/2000 | Sami | |
| 6,200,128 | B1 | | 3/2001 | Kobayashi | |
| 6,367,703 | B1 | * | 4/2002 | Morosas | 237/55 |
| 6,435,420 | B1 | * | 8/2002 | Kasai et al. | 237/12.1 |

* cited by examiner

*Primary Examiner*—Derek Boles

(57) ABSTRACT

An exhaust heat trap and redirecting system for utilizing exhaust heat includes an electric generator including an internal combustion engine. The electric generator is electrically coupled to an electrical system of a dwelling. An exhaust conduit is fluidly coupled to the engine for venting exhaust away therefrom. A substantially airtight sheath is positioned about a water tank in a water heater. The sheath comprises a cylinder having an inner wall and an outer wall. The sheath has an upper wall attached to the outer wall. A sheath inlet has a first end fluidly coupled to the sheath and a second end fluidly coupled to the exhaust conduit. A sheath outlet has a first end fluidly coupled to the upper wall of the sheath and a second end is directed outward of the dwelling.

7 Claims, 4 Drawing Sheets

EXHAUST HEAT TRAP AND REDIRECTING SYSTEM

BACKGROUND OF THE INVENTION

1. Field of the Invention

The present invention relates to heat recovering devices and more particularly pertains to a new heat recovering device that would utilize the heat provided from the exhaust of an internal combustion engine.

2. Description of the Prior Art

The use of heat recovering and cogeneration devices is known in the prior art. U.S. Pat. No. 6,200,128 describes a method and apparatus for recovering sensible heat from a hot exhaust gas. Another type of heat recovering device is U.S. Pat. No. 6,101,813 which describes an electric power generator using an exhaust source from an internal combustion engine. U.S. Pat. No. 5,910,100 describes a waste heat utilization system that is useful for removing waste heat from fluids. U.S. Pat. No. 5,603,218 describes a system for converting waste heat into power. U.S. Pat. No. 5,548,957 describes a system that recovers of power from low level heat sources.

SUMMARY OF THE INVENTION

The object of the present invention is to provide a new heat recovering device that would provide a much higher level of energy efficiency than conventional furnaces, and other conventional systems.

Another object of the present invention is to provide a new heat recovering device that would be relatively small in size so it could be utilized within a family home.

To this end, the present invention generally comprises an electric generator including an internal combustion engine. The electric generator is electrically coupled to an electrical system of a dwelling. An exhaust conduit is fluidly coupled to the engine for venting exhaust away therefrom. A substantially airtight sheath is positioned about a water tank in a water heater. The sheath comprises a cylinder having an inner wall and an outer wall. The sheath has an upper wall attached to the outer wall. A sheath inlet has a first end fluidly coupled to the sheath and a second end fluidly coupled to the exhaust conduit. A sheath outlet has a first end fluidly coupled to the upper wall of the sheath and a second end is directed outward of the dwelling.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
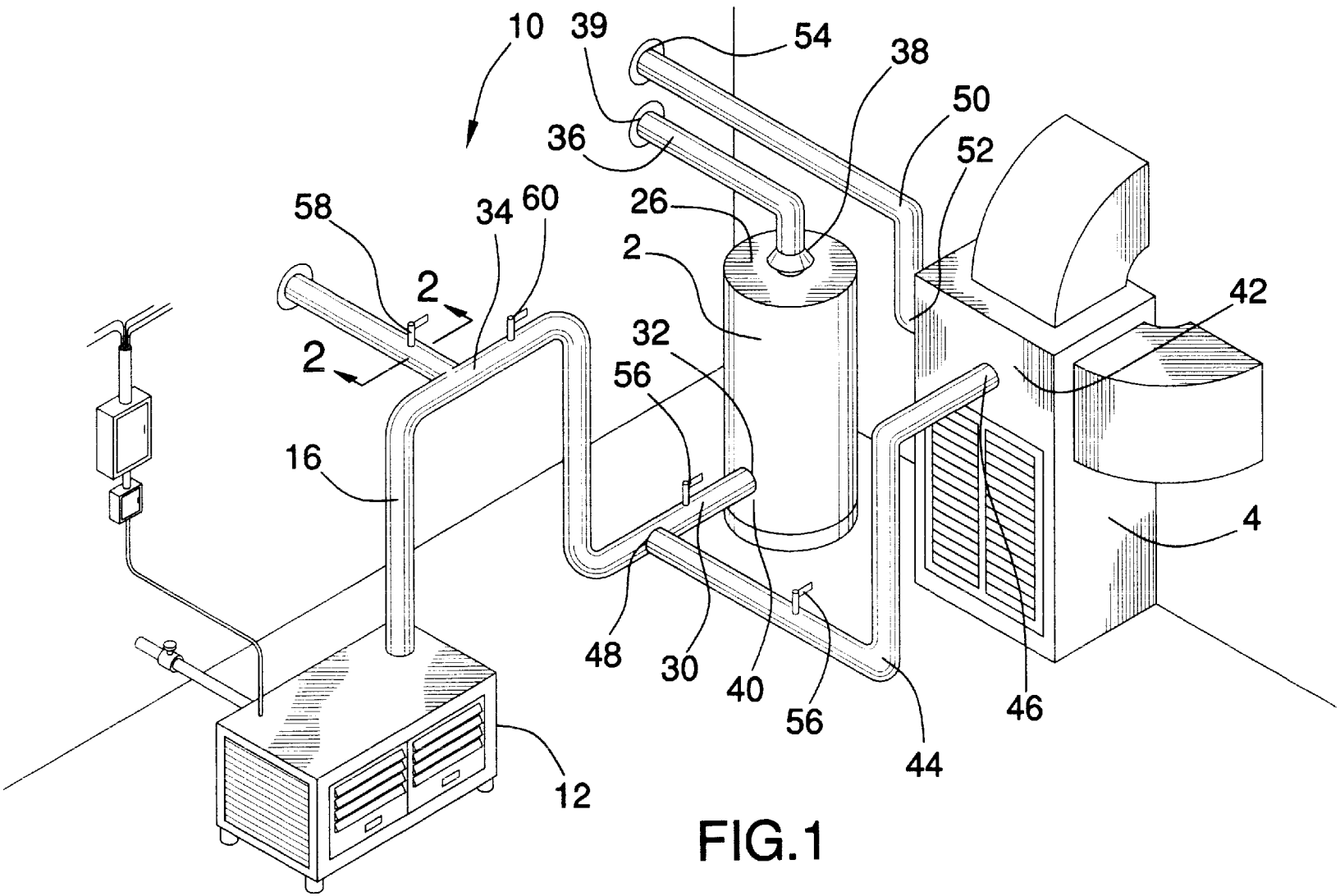
FIG. 1 is a perspective view of an exhaust heat trap and redirecting system according to the present invention.
Figure 2:
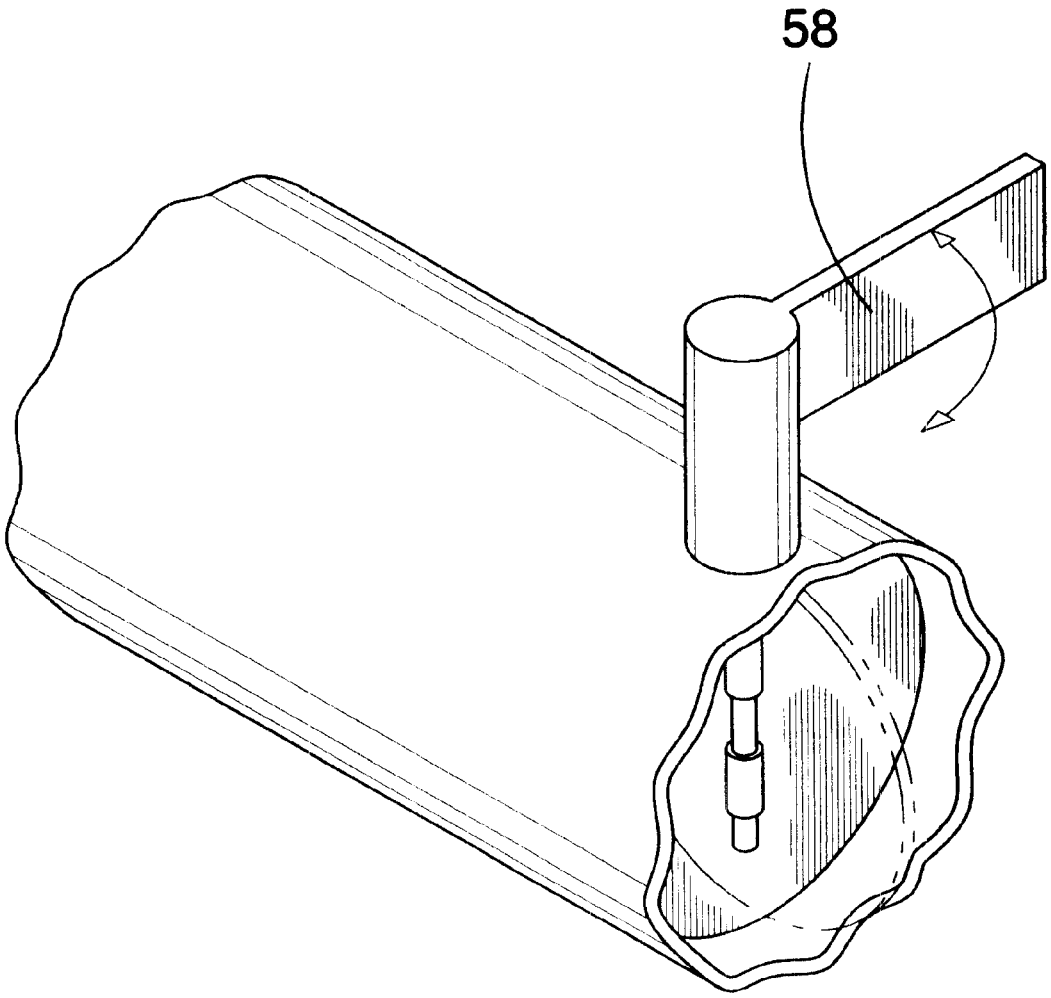
FIG. 2 is a cross-sectional view of the present invention.
Figure 3:
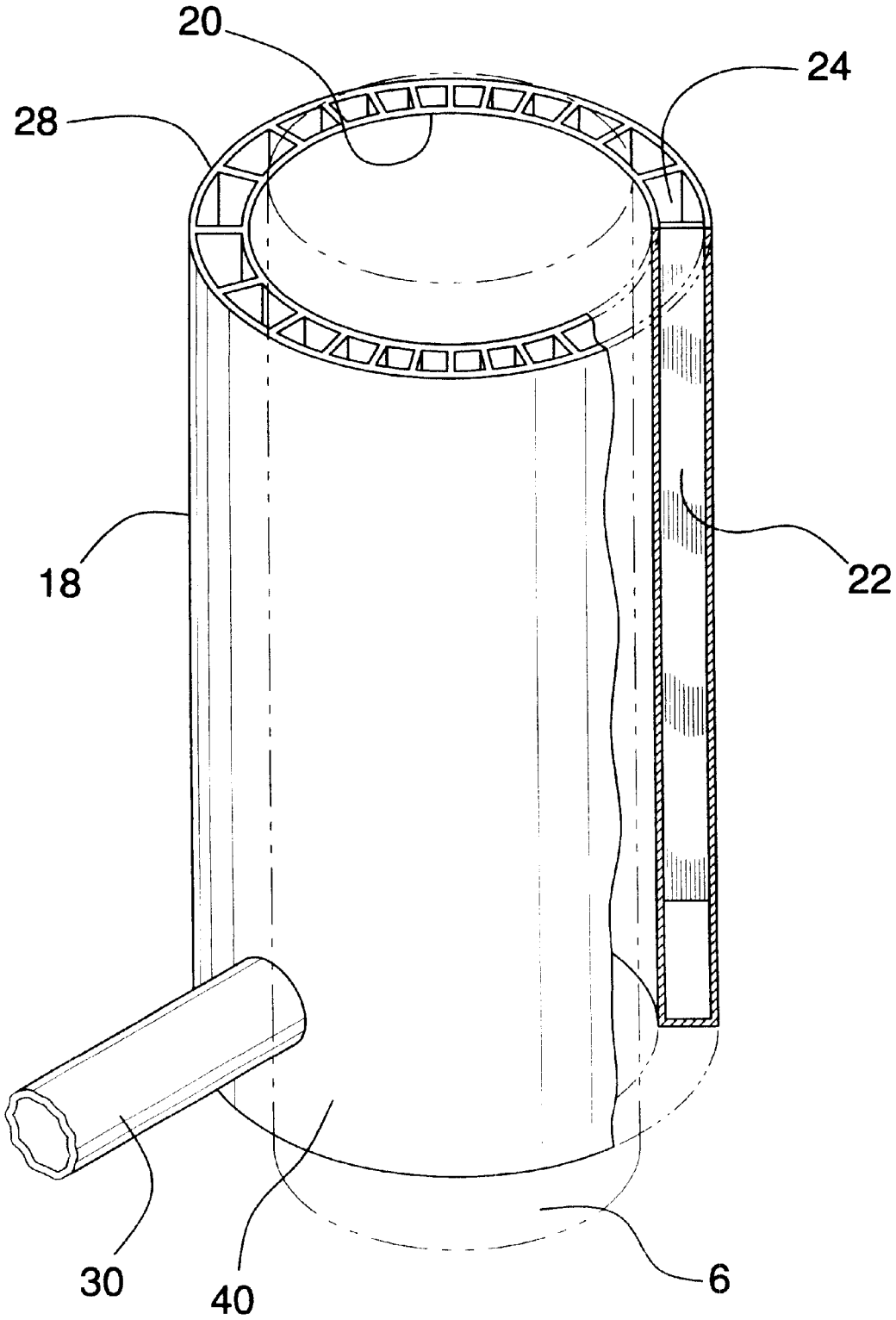
FIG. 3 is a perspective view of the present invention.
Figure 4:
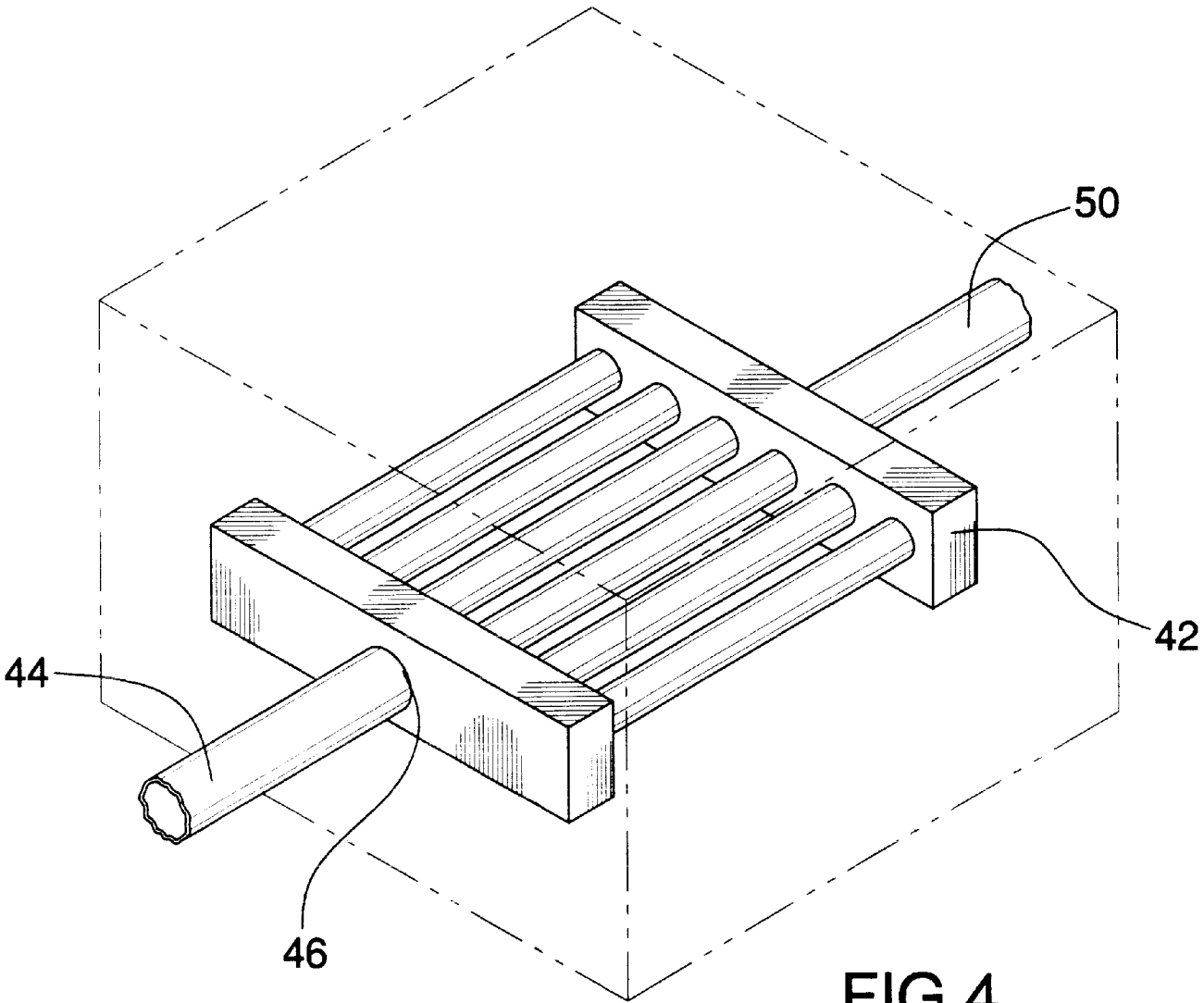
FIG. 4 is a perspective view of the present invention.

With reference now to the drawings, and in particular to FIGS. 1 through 4 thereof, a new heat recovering device embodying the principles and concepts of the present invention and generally designated by the reference numeral 10 will be described.

As best illustrated in FIGS. 1 through 4, the exhaust heat trap and redirecting system 10 generally comprises a device for coupling to the water heater 2 and furnace 4 of a dwelling. The system includes an electric generator 12 having an internal combustion engine, which is the source of the heated exhaust. The electric generator 12 is electrically coupled to an electrical system of the dwelling so that it may supply electricity to the water heater 2 and the furnace 4. An exhaust conduit 16 is fluidly coupled to the engine for venting exhaust away therefrom.

A substantially airtight sheath 18 is positioned about a water tank 6 in the water heater 4. The sheath 18 comprises a cylinder having an inner wall 20 and an outer wall 22. A plurality of vertically orientated dividing walls 22 extends between the outer wall 22 and the inner wall 20 and form sleeves 24 for passage of air along the water tank 6. The sheaths 18 extend from a point near the bottom of the sheath 18 to a point near the top of the sheath 18. The sheath 18 has an upper wall 26 attached to the outer wall 28. A sheath inlet 30 has a first end 32 fluidly coupled to the sheath 18 and a second end 34 fluidly coupled to the exhaust conduit 16. A sheath outlet 36 has a first end 38 fluidly coupled to the upper wall 26 of the sheath 18 and a second end 39 is directed outward of the dwelling. The sheath inlet 30 is fluidly coupled to a bottom portion 40 of the sheath 18 so that exhaust traveling into the sheath 18 surrounds the bottom of the water tank 6 and then flows upward through the sleeves 24.

An exhaust radiator 42 is mounted in the furnace 4 and is in fluid communication with airflow within the furnace 4. A radiator inlet 44 has a first end 46 fluidly coupled to the exhaust and a second end 48 fluidly coupled to the exhaust conduit 16. A radiator outlet 50 has a first end 52 fluidly coupled to the radiator 42 and a second end 54 is directed outward of the dwelling.

A plurality of valves 56 is fluidly coupled to the sheath inlet 30, radiator inlet 44 and exhaust conduit 16 for selectively opening and closing such. The sheath 30 and radiator 44 inlets are coupled to the exhaust conduit 16 at a position generally between the generator 12 and a first valve 58 associated with the exhaust conduit 16. In this manner, the valve 58 fluidly coupled to the exhaust conduit 16 may be closed to force the exhaust into the inlets. Ideally, a second one of the valves 60 is positioned for closing off the inlets from the exhaust conduit 16.

In use, when the generator 12 is operated, presumably to run such items as the water heater 2 and furnace 4, its exhaust travels into the sheath 18 and into the radiator 42 where it respectively heats the water tank 6 and any air flowing through the furnace 4. In this manner, the device helps to conserve energy by utilizing the heat produced by the internal combustion engine.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exhaust heat capturing and utilizing system for a dwelling having a water heater and a furnace, said system comprising:

an electric generator including an internal combustion engine, said electric generator being electrically coupled to an electrical system of the dwelling, an exhaust conduit being fluidly coupled to the engine for venting exhaust away therefrom;

a substantially airtight sheath being positioned about a water tank in the water heater, said sheath comprising a cylinder having an inner wall and an outer wall, said sheath having an upper wall being attached to said outer wall, a sheath inlet having a first end fluidly coupled to said sheath and a second end fluidly coupled to said exhaust conduit, a sheath cutlet having a first end fluidly coupled to said upper wall of said sheath and a second end being directed outward of the dwelling.

2. The exhaust heat capturing and utilizing system as in claim 1, wherein said sheath further includes a plurality of vertically orientated dividing walls extending between said outer wall and said inner wall.

3. The exhaust heat capturing and utilizing system as in claim 1, wherein said sheath inlet is fluidly coupled to a bottom portion of said sheath.

4. The exhaust heat capturing and utilizing system as in claim 1, further including an exhaust radiator being mounted in the furnace and being in fluid communication with airflow within the furnace, a radiator inlet having a first end fluidly coupled to said exhaust and a second end fluidly coupled to said exhaust conduit, a radiator outlet having a first end fluidly coupled to said radiator and a second end being directed outward of the dwelling.

5. The exhaust heat capturing and utilizing system as in claim 3, further including a plurality of valves being fluidly coupled to said sheath inlet, radiator inlet and exhaust conduit for selectively opening and closing such.

6. The exhaust heat capturing and utilizing system as in claim 4, wherein said sheath and radiator inlets are coupled to said exhaust conduit at a position generally between said generator and said valve associated with said exhaust conduit.

7. An exhaust heat capturing and utilizing system for a dwelling having a water heater and a furnace, said system comprising:

an electric generator including an internal combustion engine, said electric generator being electrically coupled to an electrical system of the dwelling, an exhaust conduit being fluidly coupled to the engine for venting exhaust away therefrom;

a substantially airtight sheath being positioned about a water tank in the water heater, said sheath comprising a cylinder having an inner wall and an outer wall, a plurality of vertically orientated dividing walls extending between said outer wall and said inner wall, said sheath having an upper wall being attached to said outer wall, a sheath inlet having a first end fluidly coupled to said sheath and a second end fluidly coupled to said exhaust conduit, a sheath outlet having a first end fluidly coupled to said upper wall of said sheath and a second end being directed outward of the dwelling, said sheath inlet being fluidly coupled to a bottom portion of said sheath;

an exhaust radiator being mounted in the furnace and being in fluid communication with airflow within the furnace, a radiator inlet having a first end fluidly coupled to said exhaust and a second end fluidly coupled to said exhaust conduit, a radiator outlet having a first end fluidly coupled to said radiator and a second end being directed outward of the dwelling;

a plurality of valves being fluidly coupled to said sheath inlet, radiator inlet and exhaust conduit for selectively opening and closing such, said sheath and radiator inlets being coupled to said exhaust conduit at a position generally between said generator and said valve associated with said exhaust conduit; and wherein exhaust gases traveling through said sheath and said radiator respectively heats the water tank and the furnace.

* * * * *